US011879262B2

(12) United States Patent
Centoni

(10) Patent No.: US 11,879,262 B2
(45) Date of Patent: Jan. 23, 2024

(54) FENCE ERECTING ASSEMBLY

(71) Applicant: Billy Centoni, Tracy, CA (US)

(72) Inventor: Billy Centoni, Tracy, CA (US)

( * ) Notice: Subject to any disclaimer, the term of this patent is extended or adjusted under 35 U.S.C. 154(b) by 228 days.

(21) Appl. No.: 17/540,554

(22) Filed: Dec. 2, 2021

(65) Prior Publication Data

US 2023/0175287 A1 Jun. 8, 2023

(51) Int. Cl.
*E04H 17/26* (2006.01)
*E04H 17/08* (2006.01)

(52) U.S. Cl.
CPC ..... *E04H 17/263* (2013.01); *E04H 17/08* (2013.01)

(58) Field of Classification Search
CPC ..... E04H 17/1413; E04H 17/1417; E04H 17/1447; E04H 17/1452; E04H 17/1488; E04H 12/22; E04H 12/2253; E04H 12/2269; E04H 17/08; E04H 17/20; E04H 17/22; E04H 17/23; E04H 17/26; E04H 17/261; E04H 17/263
See application file for complete search history.

(56) References Cited

U.S. PATENT DOCUMENTS 619,684 A * 2/1899 Emerton et al. ..... E04H 17/08 256/55
1,165,459 A * 12/1915 Sprague ..... E04H 17/23 52/153
1,316,096 A * 9/1919 James ..... E04H 17/08 52/150
3,674,243 A * 7/1972 Brown ..... E04H 17/1447 256/65.05
4,679,772 A * 7/1987 Peterson ..... E04H 17/08 256/35
4,705,262 A 11/1987 Roberts
4,763,879 A * 8/1988 Wasicek ..... E04H 17/08 256/70
4,889,322 A 12/1989 Wagner
5,042,780 A 8/1991 Yearwood
5,061,109 A 10/1991 Miller
5,518,333 A * 5/1996 Cienkus, Jr. ..... E04H 17/06 403/205
5,593,143 A * 1/1997 Ferrarin ..... E04H 17/08 248/74.1
5,649,690 A 7/1997 Kilmer
(Continued)

FOREIGN PATENT DOCUMENTS

GB 1241535 8/1971
GB 2523343 A * 8/2015 ..... E04H 17/08
KR 200476137 Y1 * 2/2015

*Primary Examiner* — Jonathan P Masinick

(57) ABSTRACT

A fence erecting assembly for anchoring a stretched fence includes a pair of posts that can each be driven into ground. A pair of lower sleeves is each slidable over a respective one of the posts and a pair of tubes is each coupled to a respective one of the lower sleeves. A pair of upper sleeves is each slidable over a respective one of the posts. A pair of support rods is each insertable through a respective one of the tubes such that each of the support rods is oriented to extend diagonally between the posts. A connection point on each of the support rods is attachable to a mounting tab on a respective one of the upper sleeves thereby inhibiting the pair of posts from tipping toward or away from each other. In this way the pair of posts can serve as an anchor point for a stretched fence.

7 Claims, 4 Drawing Sheets

(56) References Cited

U.S. PATENT DOCUMENTS

| | | | | |
|---|---|---|---|---|
| 6,406,003 | B1 * | 6/2002 | Shaw | E04H 17/08 403/336 |
| 7,377,020 | B1 | 5/2008 | Bartling | |
| 8,458,966 | B2 * | 6/2013 | O'Toole | E04H 17/22 52/146 |
| 8,991,777 | B2 | 3/2015 | Madril | |
| 10,422,155 | B2 * | 9/2019 | Goedecke | E04H 17/1417 |
| 11,371,256 | B1 * | 6/2022 | Lyons | E04H 17/1447 |
| 2014/0103279 | A1 | 4/2014 | McBride | |
| 2020/0199906 | A1 * | 6/2020 | Baeza | E04H 17/02 |
| 2021/0381188 | A1 * | 12/2021 | Wójcikowski | E01F 9/685 |

* cited by examiner

FENCE ERECTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fence devices and more particularly pertains to a new fence device for anchoring a stretched fence. The device includes a pair of posts which are sunk into the ground, a pair of upper sleeves which are positionable around the posts and a pair of lower sleeves which are positionable around the posts. A pair of support rods is attachable between respective upper and lower sleeves to extend diagonally between the posts. Additionally, a central member is attachable to the upper sleeves to extend horizontally between the posts. In this way the posts are inhibited from tipping toward or away from each other for anchoring a stretched fence.

(2) Description of Related Art Including Information Disclosed Under 37 CFR 1.97 and 1.98

The prior art relates to fence devices including a fence anchor that includes a pair of posts, a pair of diagonal support and a horizontal support. Each of the diagonal supports and the horizontal support includes loops that extend around a respective post for securing the posts. The prior art discloses a variety of fence anchors that include a vertical member and an angled member that extends diagonally between the vertical member and the ground for inhibiting the vertical member from tipping. The prior art discloses a variety of fence anchors that include a pair of posts, a single diagonal support and a pair of horizontal supports that are each attached between the posts. The prior art discloses a fence post device that includes a plurality of angled members that are pivotally coupled to the fence post for extending diagonally between the fence post and the ground.

BRIEF SUMMARY OF THE INVENTION

An embodiment of the disclosure meets the needs presented above by generally comprising a pair of posts that can each be driven into ground. A pair of lower sleeves is each slidable over a respective one of the posts and a pair of tubes is each coupled to a respective one of the lower sleeves. A pair of upper sleeves is each slidable over a respective one of the posts. A pair of support rods is each insertable through a respective one of the tubes such that each of the support rods is oriented to extend diagonally between the posts. A connection point on each of the support rods is attachable to a mounting tab on a respective one of the upper sleeves thereby inhibiting the pair of posts from tipping toward or away from each other. In this way the pair of posts can serve as an anchor point for a stretched fence.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
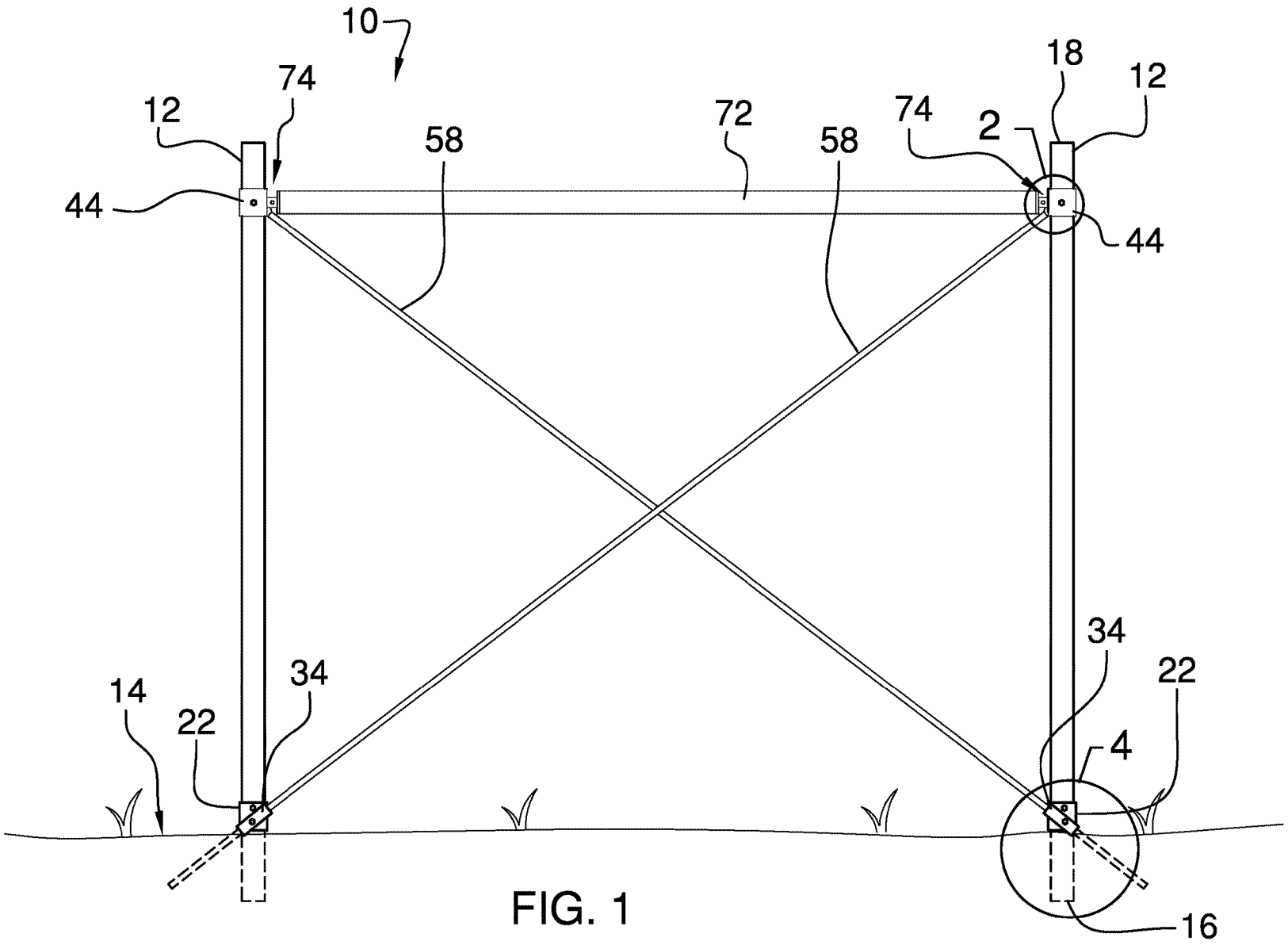
FIG. 1 is a perspective in-use view of a fence erecting assembly according to an embodiment of the disclosure.
Figure 2:
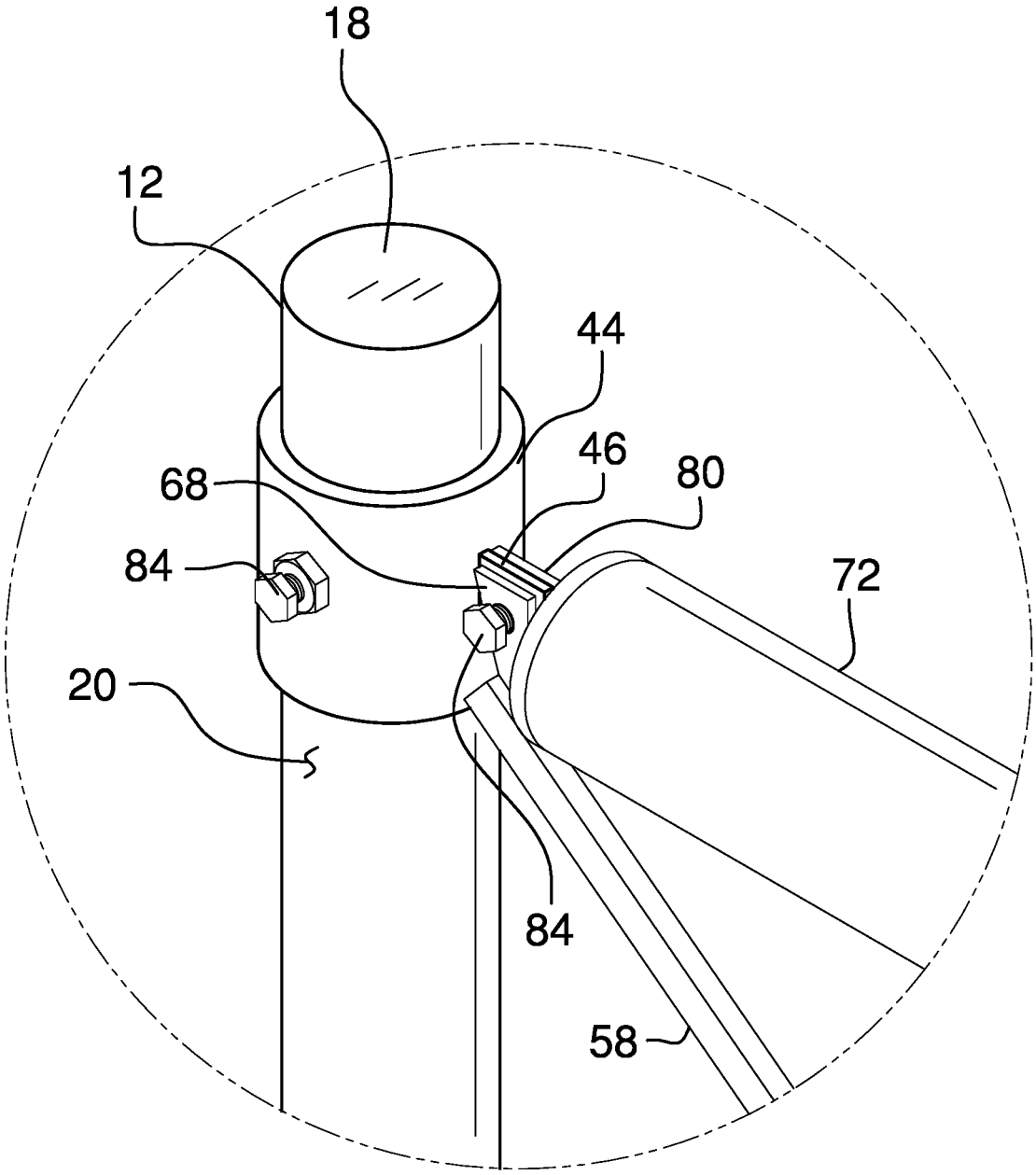
FIG. 2 is a detail view taken from circle 2 of FIG. 1 of an embodiment of the disclosure.
Figure 3:
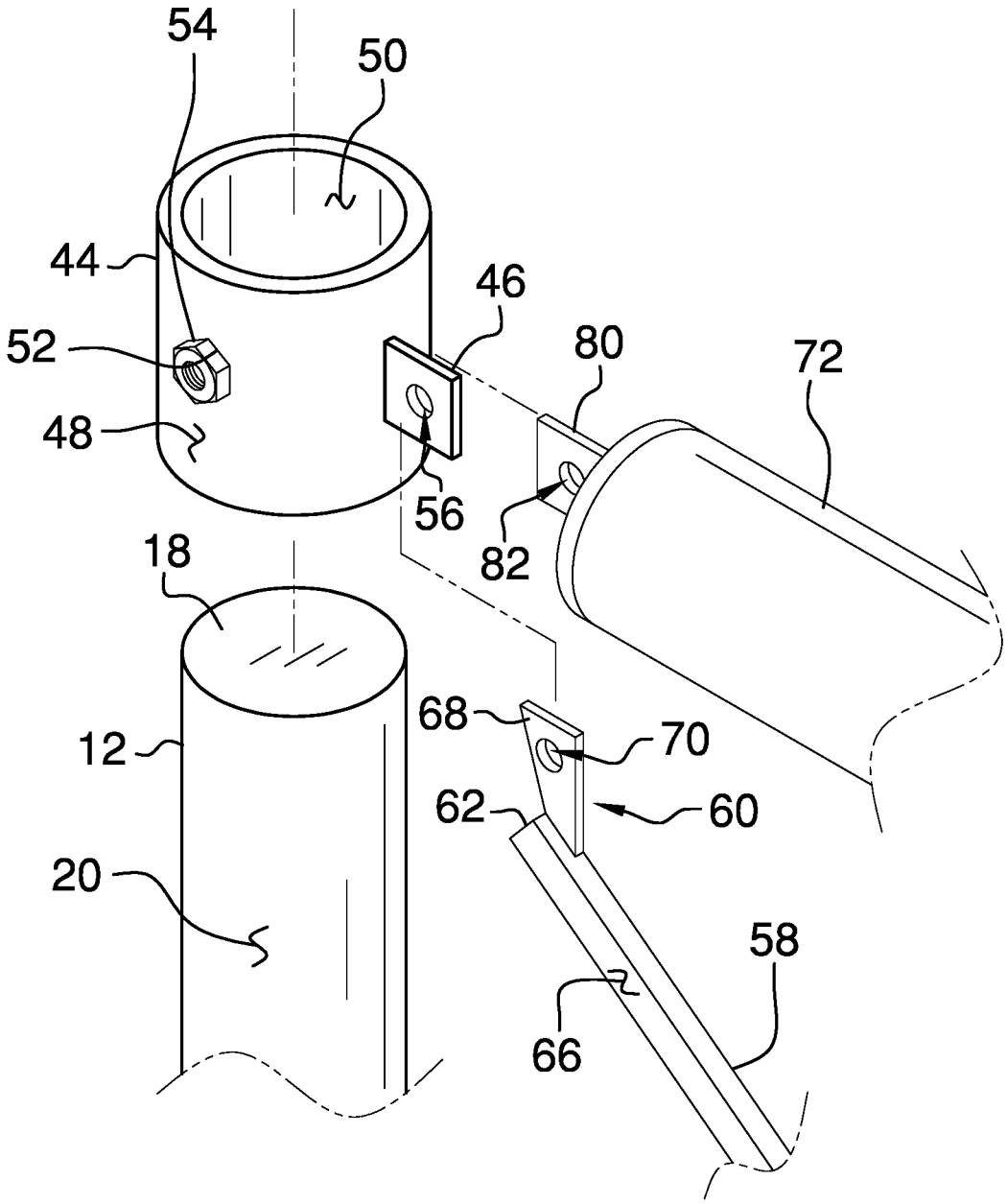
FIG. 3 is an exploded perspective view of an embodiment of the disclosure.
Figure 4:
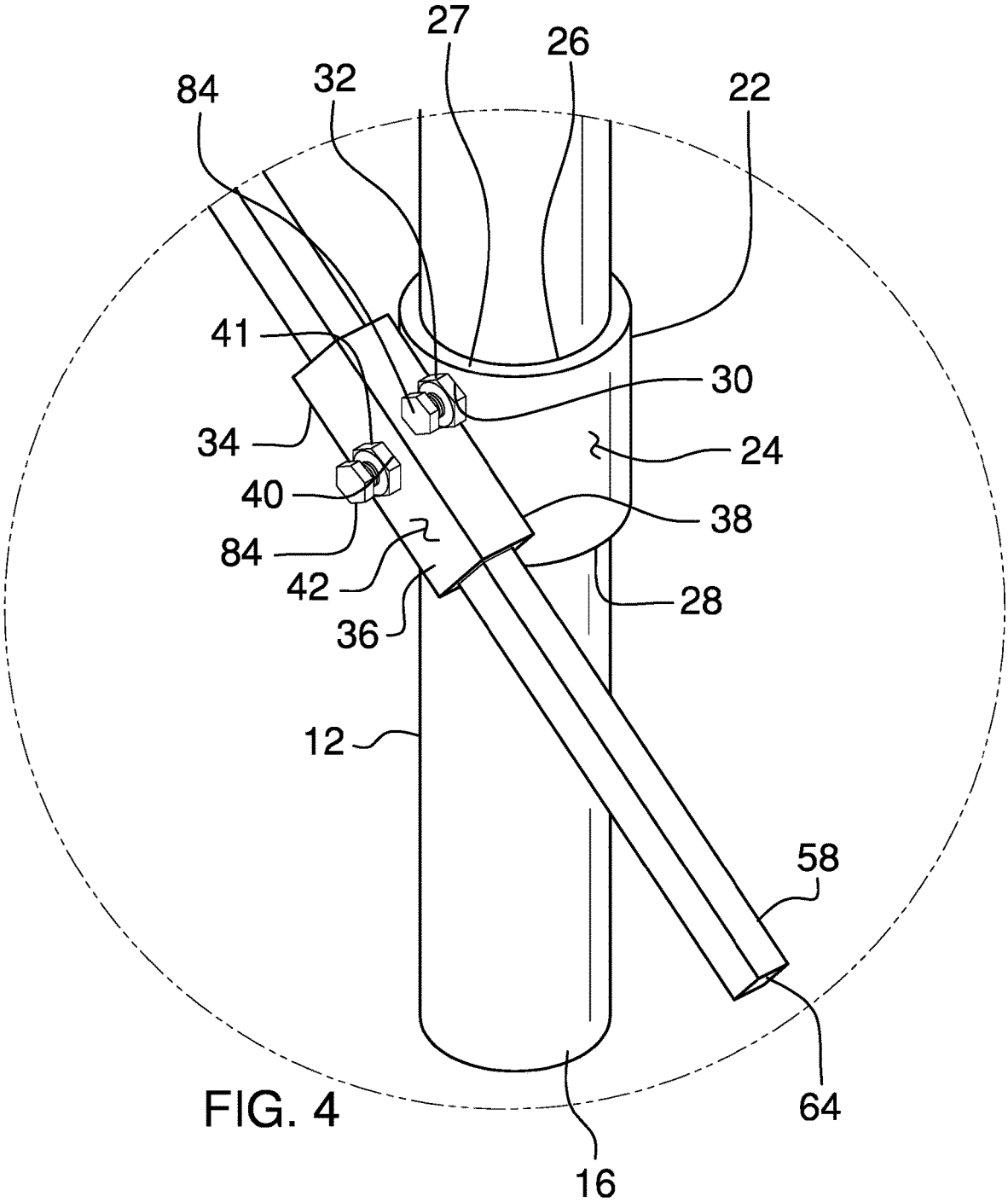
FIG. 4 is a detail view taken from circle 4 of FIG. 1 of an embodiment of the disclosure.

With reference now to the drawings, and in particular to FIGS. 1 through 4 thereof, a new fence device embodying the principles and concepts of an embodiment of the disclosure and generally designated by the reference numeral 10 will be described.

As best illustrated in FIGS. 1 through 4, the fence erecting assembly 10 generally comprises a pair of posts 12 that can each be driven into ground 14 having the posts 12 being vertically oriented. Each of the posts 12 has a lower end 16, an upper end 18 and an outer surface 20 extending between the upper end 18 and the lower end 16, and each of the posts 12 may have a length of at least 5.0 feet. A pair of lower sleeves 22 is provided and each of the lower sleeves 22 is slidable over a respective one of the posts 12 having each of the lower sleeves 22 being positioned adjacent to the lower end 16 of the respective post 12.

Each of the lower sleeves 22 has an outside surface 24, an inside surface 26, a first end 27 and a second end 28. Additionally, each of the lower sleeves 22 has a hole 30 extending through the outside surface 24 and the inside surface 26. Each of the lower sleeves 22 has a nut 32 that is bonded to the outside surface 24 and the nut 32 is aligned with the hole 30. The nut 32 may be a threaded fastener commonly used with threaded bolts.

A pair of tubes 34 is provided and each of the tubes 34 is coupled to a respective one of the lower sleeves 22. Each of the tubes 34 is oriented at an angle on the respective lower sleeve 22. In this way each of the tubes 34 is directed toward the upper end 18 of an opposite one of the posts 12 with respect to the post 12 on which the respective lower sleeve 22 is positioned. Each of the tubes 34 has a front wall 36 and a back wall 38, and the back wall 38 is bonded to the outside surface 24 of the respective lower sleeve 22. Each of the tubes 34 is oriented to extend diagonally between the first end 27 and the second end 28 of the respective lower sleeve 22. Furthermore, the front wall 36 of each of the tubes 34 has a hole 40 extending through the front wall 36. Each of the tubes 34 has a nut 41 that is bonded to an outer surface 42 of the front wall 36 and the nut 41 on the front wall 36 is aligned with the hole 40 in the front wall 36. Additionally, each of the tubes 34 may have a rectangular cross section.

A pair of upper sleeves 44 is provided and each of the upper sleeves 44 is slidable over a respective one of the posts 12 having each of the upper sleeves 44 being positioned adjacent to the upper end 18 of the respective post 12. Each of the upper sleeves 44 has a mounting tab 46 extending away from a respective upper sleeve 44, and each of the upper sleeves 44 has an outer surface 48 and an inner surface 50. Each of the upper sleeves 44 has a hole 52 extending through the outer surface 48 and the inner surface 50 of the upper sleeve 44. Additionally, each of the upper sleeves 44 has a nut 54 that is bonded to the outer surface 48 of the upper sleeve 44. The nut 54 on each of the upper sleeves 44 is aligned with the hole 52 in the upper sleeves 44. Furthermore, the mounting tab 46 on each of the upper sleeves 44 extends away from the outer surface 48 of the upper sleeves 44, and the mounting tab 46 has an opening 56 extending through the mounting tab 46.

A pair of support rods 58 is provided and each of the support rods 58 is insertable through a respective one of the tubes 34 when the lower sleeves 22 are positioned around the posts 12. In this way each of the support rods 58 is oriented to extend diagonally between the posts 12. Each of the support rods 58 has a connection point 60 that is integrated into the support rods 58. The connection point 60 on each of the support rods 58 is attachable to the mounting tab 46 on a respective one of the upper sleeves 44 when the respective upper sleeve 44 is positioned on the respective post 12. In this way the pair of posts 12 is inhibited from tipping toward or away from each other thereby facilitating the pair of posts 12 to be an anchor point for a stretched fence. The stretched fence may be a barbed wire fence, a wire fence or any other type of stretched fence.

Each of the support rods 58 has a primary end 62, a secondary end 64 and an exterior surface 66 extending between the primary end 62 and the secondary end 64. The secondary end 64 of each of the support rods 58 is insertable through a respective one of the tubes 34. Each of the support rods 58 has a first coupling tab 68 that extends away from the exterior surface 66 to define the connection point 60 on the support rods 58. The first coupling tab 68 is positioned adjacent to the primary end 62.

Each of the support rods 58 is oriented in the respective tube 34 such that the first coupling tab 68 on each of the support rods 58 is directed upwardly on the support rod 58. The first coupling tab 68 on each of the support rods 58 has an opening 70 extending through the first coupling tab 68. The opening 70 in the first coupling tab 68 is aligned with the opening 56 in the mounting tab 46 when the support rods 58 are inserted into the tubes 34. Additionally, each of the support rods 58 may have a rectangular cross section that corresponds to the rectangular cross section of the tubes 34. In this way the support rods 58 may be inhibited from rotating in the tubes 34.

A central member 72 is provided that has a pair of connection points 74 each being disposed on opposite ends of the central member 72. Each of the connection points 74 on the central member 72 engages the mounting tab 46 on a respective one of the upper sleeves 44 when the upper sleeves 44 are positioned around the posts 12. In this way the central member 72 inhibits the posts 12 from tipping toward or away from each other. The central member 72 has a first end 76 and a second end 78, and the central member 72 has a pair of second coupling tabs 80 that is each coupled to and extends away from a respective one of the first end 76 and the second end 78 of the central member 72. Each of the second coupling tabs 80 has an opening 82 extending through the second coupling tabs 80. The opening 82 in each of the second coupling tabs 80 is aligned with the opening 56 in the mounting tab 46 on the respective upper sleeve 44.

A plurality of bolts 84 is provided and each of the bolts 84 is threadable into the nut 32 on a respective one of the lower sleeves 22, the nut 54 on a respective one of the upper sleeves 44 and the nut 41 on a respective one of the tubes 34. Each of the bolts 84 is tightenable to engage a respective one of the posts 12 or a respective one of the support rods 58. In this way the upper sleeves 44 and the lower sleeves 22 can be retained at a selected point along the respective post 12. Additionally, each of the support rods 58 can be retained to extend a selected distance outwardly from the respective tube 34. Each of the bolts 84 may comprise a threaded hex bolt or other similar type of bolt.

In use, each of the posts 12 is driven into the ground 14 such that the posts 12 are spaced a pre-determined distance apart from each other. The posts 12 may be located on level ground or the posts 12 may be located on an incline. Each of the lower sleeves 22 is positioned around a respective post 12 and each of the upper sleeves 44 is positioned around a respective post 12. Additionally, each of the upper sleeves 44 and each of the lower sleeves 22 are secured at a selected height on the respective post 12. Each of the support rods 58 is inserted into the respective tube 34 and the first coupling tab 68 on each of the support rods 58 is engaged to the mounting tab 46 on the respective upper sleeve 44. Additionally, each of the second coupling tabs 80 on the central member 72 is engaged to the mounting tab 46 on the respective upper sleeve 44. In this way the posts 12 are inhibited from tipping toward or away from each other thereby facilitating the posts 12 to serve as an anchor point for the stretched fence.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fence erecting assembly for establishing an anchor point for a fence line, said assembly comprising:

a pair of posts each being configured to be driven into ground having said posts being vertically oriented;

a pair of lower sleeves, each of said lower sleeves being slidable over a respective one of said posts;

a pair of tubes, each of said tubes being coupled to a respective one of said lower sleeves, each of said tubes being oriented at an angle on said respective lower sleeve such that each of said tubes is directed toward said upper end of an opposite one of said posts with respect to said post on which said respective lower sleeve is positioned;

a pair of upper sleeves, each of said upper sleeves being slidable over a respective one of said posts, each of said upper sleeves having a mounting tab extending away from a respective upper sleeve;

a pair of support rods, each of said support rods being insertable through a respective one of said tubes when said lower sleeves are positioned around said posts such that each of said support rods is oriented to extend diagonally between said posts, each of said support rods having a connection point being integrated into said support rods, said connection point on each of said support rods being attachable to said mounting tab on a respective one of said upper sleeves when said respective upper sleeve is positioned on said respective post thereby inhibiting said pair of posts from tipping toward or away from each other wherein said pair of posts are configured to be an anchor point for a stretched fence; and a central member having a pair of connection points each being disposed on opposite ends of said central member, each of said connection points on said central member engaging said mounting tab on a respective one of said upper sleeves when said upper sleeves are positioned around said posts such that said central member inhibits said posts from tipping toward or away from each other.

2. The assembly according to claim 1, wherein:

each of said posts has a lower end, an upper end and an outer surface extending between said upper end and said lower end;

each of said lower sleeves has an outside surface, an inside surface, a first end and a second end, each of said lower sleeves having a hole extending through said outside surface and said inside surface, each of said lower sleeves having a nut being bonded to said outside surface, said nut being aligned with said hole, each of said lower sleeves being positioned adjacent to said lower end of said respective post; and each of said upper sleeves has an outer surface and an inner surface, each of said upper sleeves having a hole extending through said outer surface and said inner surface of said upper sleeve, each of said upper sleeves having a nut being bonded to said outer surface of said upper sleeve, said nut on each of said upper sleeves being aligned with said hole in said upper sleeves, said mounting tab on each of said upper sleeves extending away from said outer surface of said upper sleeves, said mounting tab having an opening extending through said mounting tab, each of said upper sleeves being positioned adjacent to said upper end of said respective post.

3. The assembly according to claim 2, wherein each of said tubes has a front wall and a back wall, said back wall being bonded to said outside surface of said respective lower sleeve, each of said tubes being oriented to extend diagonally between said first end and said second end of said respective lower sleeve, said front wall of each of said tubes having a hole extending through said front wall, each of said tubes having a nut being bonded to an outer surface of said front wall, said nut on said front wall being aligned with said hole in said front wall.

4. The assembly according to claim 1, wherein each of said support rods has a primary end, a secondary end and an exterior surface extending between said primary end and said secondary end, said secondary end of each of said support rods being insertable through a respective one of said tubes, each of said support rods having a first coupling tab extending away from said exterior surface to define said connection point on said support rods, said first coupling tab being positioned adjacent to said primary end, each of said support rods being oriented in said respective tube such that said first coupling tab on each of said support rods is directed upwardly on said support rod, said first coupling tab on each of said support rods having an opening extending through said first coupling tab, said opening in said first coupling tab being aligned with an opening in said mounting tab when said support rods are inserted into said tubes.

5. The assembly according to claim 1, wherein:

each of said support rods has a first coupling tab; and said central member has a first end and a second end, said central member having a pair of second coupling tabs each being coupled to and extending away from a respective one of said first end and said second end of said central member, each of said second coupling tabs having an opening extending through said second coupling tabs, said opening in each of said second coupling tabs being aligned with said opening in said mounting tab on said respective upper sleeve.

6. The assembly according to claim 1, further comprising a plurality of bolts, each of said bolts being threadable into a nut on a respective one of said lower sleeves, a nut on a respective one of said upper sleeves and a nut on a respective one of said tubes, each of said bolts being tightenable to engage a respective one of said posts or a respective one of said support rods.

7. A fence erecting assembly for establishing an anchor point for a fence line, said assembly comprising:

a pair of posts each being configured to be driven into ground having said posts being vertically oriented, each of said posts having a lower end, an upper end and an outer surface extending between said upper end and said lower end;

a pair of lower sleeves, each of said lower sleeves being slidable over a respective one of said posts having each of said lower sleeves being positioned adjacent to said lower end of said respective post, each of said lower sleeves having an outside surface, an inside surface, a first end and a second end, each of said lower sleeves having a hole extending through said outside surface and said inside surface, each of said lower sleeves having a nut being bonded to said outside surface, said nut being aligned with said hole;

a pair of tubes, each of said tubes being coupled to a respective one of said lower sleeves, each of said tubes being oriented at an angle on said respective lower sleeve such that each of said tubes is directed toward said upper end of an opposite one of said posts with respect to said post on which said respective lower sleeve is positioned, each of said tubes having a front wall and a back wall, said back wall being bonded to said outside surface of said respective lower sleeve, each of said tubes being oriented to extend diagonally between said first end and said second end of said respective lower sleeve, said front wall of each of said tubes having a hole extending through said front wall, each of said tubes having a nut being bonded to an outer surface of said front wall, said nut on said front wall being aligned with said hole in said front wall;

a pair of upper sleeves, each of said upper sleeves being slidable over a respective one of said posts having each of said upper sleeves being positioned adjacent to said upper end of said respective post, each of said upper sleeves having a mounting tab extending away from a respective upper sleeve, each of said upper sleeves having an outer surface and an inner surface, each of said upper sleeves having a hole extending through said outer surface and said inner surface of said upper sleeve, each of said upper sleeves having a nut being bonded to said outer surface of said upper sleeve, said nut on each of said upper sleeves being aligned with said hole in said upper sleeves, said mounting tab on each of said upper sleeves extending away from said outer surface of said upper sleeves, said mounting tab having an opening extending through said mounting tab;

a pair of support rods, each of said support rods being insertable through a respective one of said tubes when said lower sleeves are positioned around said posts such that each of said support rods is oriented to extend diagonally between said posts, each of said support rods having a connection point being integrated into said support rods, said connection point on each of said support rods being attachable to said mounting tab on a respective one of said upper sleeves when said respective upper sleeve is positioned on said respective post thereby inhibiting said pair of posts from tipping toward or away from each other wherein said pair of posts are configured to be an anchor point for a stretched fence, each of said support rods having a primary end, a secondary end and an exterior surface extending between said primary end and said secondary end, said secondary end of each of said support rods being insertable through a respective one of said tubes, each of said support rods having a first coupling tab extending away from said exterior surface to define said connection point on said support rods, said first coupling tab being positioned adjacent to said primary end, each of said support rods being oriented in said respective tube such that said first coupling tab on each of said support rods is directed upwardly on said support rod, said first coupling tab on each of said support rods having an opening extending through said first coupling tab, said opening in said first coupling tab being aligned with said opening in said mounting tab when said support rods are inserted into said tubes;

a central member having a pair of connection points each being disposed on opposite ends of said central member, each of said connection points on said central member engaging said mounting tab on a respective one of said upper sleeves when said upper sleeves are positioned around said posts such that said central member inhibits said posts from tipping toward or away from each other, said central member having a first end and a second end, said central member having a pair of second coupling tabs each being coupled to and extending away from a respective one of said first end and said second end of said central member, each of said second coupling tabs having an opening extending through said second coupling tabs, said opening in each of said second coupling tabs being aligned with said opening in said mounting tab on said respective upper sleeve; and a plurality of bolts, each of said bolts being threadable into said nut on a respective one of said lower sleeves, said nut on a respective one of said upper sleeves and said nut on a respective one of said tubes, each of said bolts being tightenable to engage a respective one of said posts or a respective one of said support rods.

* * * * *